US009136608B2

(12) United States Patent
Yano

(10) Patent No.: US 9,136,608 B2
(45) Date of Patent: Sep. 15, 2015

(54) SLOT ARRAY ANTENNA

(75) Inventor: Koji Yano, Nishinomiya (JP)

(73) Assignee: Furuno Electric Company Limited, Hyogo (JP)

( * ) Notice: Subject to any disclaimer, the term of this patent is extended or adjusted under 35 U.S.C. 154(b) by 1666 days.

(21) Appl. No.: 12/310,825

(22) PCT Filed: Aug. 8, 2007

(86) PCT No.: PCT/JP2007/065480

§ 371 (c)(1), (2), (4) Date: Mar. 9, 2009

(87) PCT Pub. No.: WO2008/018481

PCT Pub. Date: Feb. 14, 2008

(65) Prior Publication Data

US 2010/0085263 A1 Apr. 8, 2010

(30) Foreign Application Priority Data

Aug. 11, 2006 (JP) ..... 2006-220339

(51) Int. Cl.
*H01Q 13/10* (2006.01)
*H01Q 13/22* (2006.01)
*H01Q 21/06* (2006.01)

(52) U.S. Cl.
CPC ..... *H01Q 13/22* (2013.01); *H01Q 21/064* (2013.01)

(58) Field of Classification Search
CPC ..... H01Q 21/064; H01Q 13/22; H01Q 13/10
USPC ..... 343/767, 770, 771
See application file for complete search history.

(56) References Cited

U.S. PATENT DOCUMENTS 3,599,216 A 8/1971 Paine et al.
4,429,313 A * 1/1984 Muhs et al. ..... 343/771

(Continued)

FOREIGN PATENT DOCUMENTS

GB 0830754 A 3/1960
GB 1156931 A 7/1969
JP 56087902 A 7/1981
JP 05090833 A 4/1993

(Continued)

OTHER PUBLICATIONS

United Kingdom Office Action for Application No. GB0904126.0 dated Jul. 12, 2010.

*Primary Examiner* — Michael C Wimer
(74) *Attorney, Agent, or Firm* — Nutter McClennen & Fish LLP; John J. Penny, Jr.; Michael P. Visconti, III

(57) ABSTRACT

A slot array antenna is provided. In one embodiment, the slot array antenna includes a radiation waveguide having a first conductor plane in which a slot array is two-dimensionally arrayed and a second conductor plane in parallel thereto, and an introduction waveguide formed with a slot array, for introducing electromagnetic waves in a waveguide space of the radiation waveguide. Each slot of the slot array of the introduction waveguide is provided at an ½ wavelength or odd-number multiple of ½ wavelength of a wavelength inside the waveguide with respect to a direction of propagating the electromagnetic waves in the introduction waveguide, and the slots are tilted in the same direction, and thereby exciting electromagnetic waves in a high-order mode of a TE-mode in the radiation waveguide 30.

17 Claims, 11 Drawing Sheets

(56) References Cited

U.S. PATENT DOCUMENTS

| | | | |
|---|---|---|---|
| 4,755,821 | A | 7/1988 | Itoh et al. |
| 5,010,351 | A | 4/1991 | Kelly |

FOREIGN PATENT DOCUMENTS

| | | | |
|---|---|---|---|
| JP | 2003152441 | A | 5/2003 |
| JP | 2004266426 | A | 9/2004 |

* cited by examiner

-- PRIOR ART --

SLOT ARRAY ANTENNA

TECHNICAL FIELD

The present invention relates to a slot array antenna for a radar. This slot array antenna may also be used as an antenna for communication, broadcasting or the like.

BACKGROUND

Although a slot array antenna having a plurality of slots resonant with transmitted and received electromagnetic waves arrayed on side faces of a waveguide generally has low gain and high side-lobe level characteristics, a slot array antenna in which an aperture distribution of amplitude is made to be a desired distribution is disclosed in JP-A-H02-288708 to improve the characteristics.

Further, a parallel plate slot antenna in which a square-shaped parallel-plate waveguide is used with two slots as a unit of a radiation element to cancel out reflections from each other to suppress the reflections by the slots is disclosed in JP-B2-2526393.

SUMMARY

Technical Problem

Hereinafter, a case where the present invention is implemented as a slot array antenna for a rador will be explained.

The structure of the slot array antenna disclosed in JP-A-H02-288708 will be explained based on FIG. 1. In FIG. 1, a plurality of slots 9 tilted in the directions of 45° to the right and left are formed in an introduction waveguide 10 at a pitch of one-half of the wavelength λg in the waveguide. On the other hand, a waveguide space S is constructed with two parallel conductor planes, and slots 1*a* are formed in the conductor plane on the side of a radiation face. The electromagnetic waves radiated from the slots 9 of the introduction waveguide 10 are radiated into the waveguide space S, and TEM-mode electromagnetic waves then propagate. Broken-line loops in the diagram represent magnetic field loops thereof, and the solid-line arrows represent directions and a distribution of electric currents flowing in the conductor plane (guide-wall currents). The plurality of slots 1*a* formed in a first conductor plane are formed in a direction to cut off the guide-wall currents described above. Electromagnetic waves of horizontally polarized waves are radiated from these slots 1*a*.

Note that a case where the plurality of slots 9 tilted in the directions of 45° to the left or to the right are formed in the introduction waveguide 10 at a pitch of the wavelength λg in the waveguide also works similarly as well.

Also in JP-B2-2526393, electromagnetic waves in the TEM-mode propagate in a waveguide space (parallel-plate waveguide), and the electromagnetic waves are then radiated from radiation slot pairs. In JP-B2-2526393, although power-supply slot pairs tilted in the same direction are arrayed in an introduction waveguide (power-supply waveguide), because the slot pairs propagate the electromagnetic waves in the TEM-mode into a waveguide space, the intervals of these slot pairs are so determined that the slot pairs supply the waveguide space with electromagnetic waves in the same direction at the same phase.

However, such slot array antennas disclosed in JP-A-H02-288708 and JP-B2-2526393 are not capable of controlling the intensity of electromagnetic waves radiated from each slot. Although a method of weighting the intensities of electromagnetic waves radiated from each slot is effective to control a directivity of the antenna, the slot array antennas disclosed in JP-A-H02-288708 and JP-B2-2526393 are not capable of performing such weighting due to their structures, which does not allow the control of directivity.

Also in JP-A-H02-288708, 2, there is a problem that it is not possible to perform an optimum side-lobe control, because it is not possible to control the intensity distribution of electromagnetic waves radiated from the plurality of slots formed in one of the two conductor planes constituting a waveguide space.

Therefore, an objective of the present invention is to provide a slot array antenna that exhibits a high gain and a high efficiency, is capable of performing a side-lobe control, and is applicable to various polarized waves.

Another objective of the present invention is to provide a slot array antenna, the structure of which is simplified, and which is lightweight.

Solution to Problem

In order to solve the problems described above, a slot array antenna is configured as follows.

(1) A slot array antenna according to an aspect of the present invention includes: a radiation waveguide having a first conductor plane in which a slot array is two-dimensionally arrayed, a second conductor plane in parallel to the first conductor plane, and side faces closing the first and second conductor planes, and having a slot array in the first conductor plane so that a space surrounded by the first and second conductor planes and the side faces is set to be a waveguide space; an introduction waveguide having a slot array for introducing electromagnetic waves into the waveguide space, and an excitation means for exciting the electromagnetic waves in the introduction waveguide, the slot array antenna is characterized in that: each slot of the slot array formed in the introduction waveguide is provided at every ½ wavelength or integer multiple of ½ wavelength of the electromagnetic waves inside the introduction waveguide in the direction propagating the electromagnetic waves in the introduction waveguide, and electromagnetic waves of a high-order mode are excited in the radiation waveguide where a plurality of magnetic loops are arranged in the direction of propagating the electromagnetic waves in the introduction waveguide; and the slot array formed in the first conductor plane of the radiation waveguide is formed such that primary wave polarizing planes of radiated electric fields are oriented to the same direction by coupling to the electromagnetic waves of the high-order mode, and polarized wave components perpendicular to the primary wave polarizing planes cancel out for each other.

(2) Some slots among the slots formed in the radiation waveguide may extend to the side face of the radiation waveguide.

(3) The first and second conductor planes of the radiation waveguide may be made from metal plates, and a supporting member may be provided at a node of the electromagnetic waves propagating inside the radiation waveguide to secure the metal plates together that constitute the first and second conductor planes.

(4) A shape or an arrangement of each of the slots of the slot array formed in the first conductor plane of the radiation waveguide may be determined such that an intensity of the radiated electromagnetic waves is lower as departing from the center of the radiation waveguide in the direction propagating the electromagnetic waves toward directions of both ends thereof.

(5) Further, the slot array antenna according to the aspect of the present invention may be configured so that the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

Advantageous Effects of Invention (1) Each slot of the slot array formed in the introduction waveguide causes electromagnetic waves to be excited in a high-order mode in which a plurality of peaks of an electric field distribution in the direction of propagating the electromagnetic waves in the radiation waveguide, and a plurality of magnetic loops are arranged vertically and horizontally. Therefore, the slots formed in the radiation waveguide are possible to cut off the guide-wall current in the high-order mode described above at arbitrary positions while the radiation of the electromagnetic waves is conducted from the first conductor plane.

(2) Some slots of the slot array formed in the radiation waveguide may extend to the side face of the radiation waveguide. Therefore, a surface area of the radiation waveguide is effectively utilized, and the gain and efficiency can be increased without increasing the entire size of the slot array.

(3) The first and second conductor planes constituting the waveguide space may be made from metal plates, and the metal plates forming the first and second conductor planes of the electromagnetic waves propagating inside the radiation waveguide may be secured together with the supporting member. Therefore, a rigidity of the radiation waveguide can be increased without affecting to the electromagnetic waves propagating in the radiation waveguide. Thus, even when the slot array antenna is rotated by using a motor, or it is mounted on a moving vehicle a predetermined antenna characteristic can be obtained.

(4) The intensity of the electromagnetic waves radiated from each slot of the slot array formed in the radiation waveguide may be made to be lower as departing from the center of the radiation waveguide in the direction of propagating the electromagnetic waves (longitudinal direction) toward both ends thereof. Therefore, the side lobes can be effectively suppressed.

(5) The slot array antenna may include a plurality of slot pairs perpendicular to each other, and the length or shape of the slot may be determined so that the phases of the electromagnetic waves radiated from the two slots constituting each of the pair differ by 90°. Therefore, a slot array antenna adapted to circular polarized waves can be configured.

DESCRIPTION OF EMBODIMENTS

A slot array antenna according to Embodiment 1 will be described referring to FIGS. 2 to 5.

Figure 1:
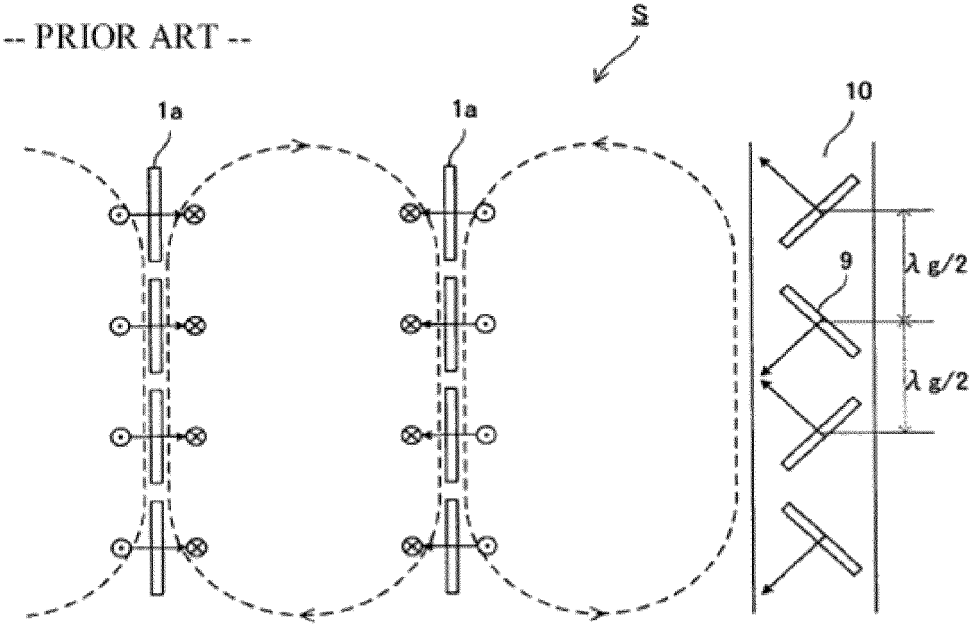
FIG. 1 is a diagram showing a relationship between an arrangement of slots of an introduction waveguide and an electromagnetic wave propagation mode inside a radiation waveguide of a slot array antenna shown in JP-A-H02-288708.
Figure 2:
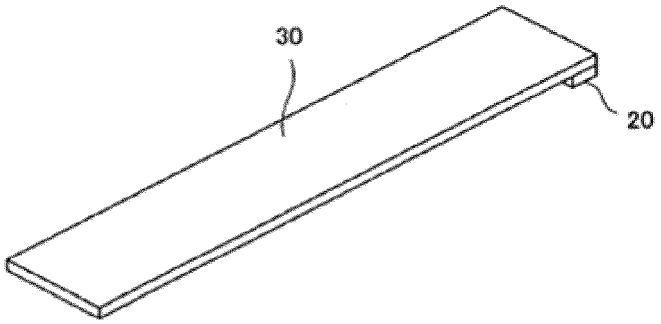
FIG. 2 is an external perspective view of a slot array antenna according to Embodiment 1.

FIG. 2 is an external perspective view of the slot array antenna according to Embodiment 1. This slot array antenna mainly includes an introduction waveguide 20 and a radiation waveguide 30. The introduction waveguide 20 is provided to introduce electromagnetic waves into the radiation waveguide 30, and is formed with slots as described later. Further, the radiation waveguide 30 has first and second conductor planes that are in parallel to each other and side faces that close the end portions of the conductor planes, inside of which is a waveguide space. Although a plurality of slot arrays are formed in the top face of this radiation waveguide 30 in the figure, illustration thereof are omitted in FIG. 2. The introduction waveguide 20 and radiation waveguide 30 are manufactured by punching and bending aluminum plates as described later.

Figure 3A:
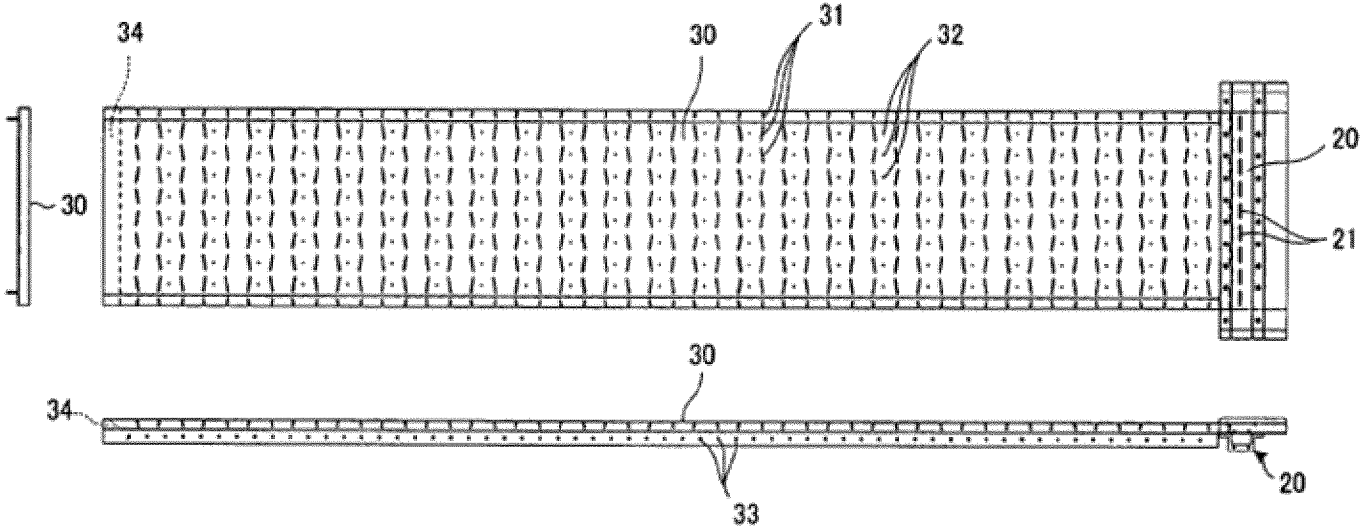
FIG. 3(A) is a three-way view of the slot array antenna.
Figure 3B:
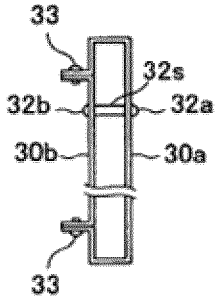
FIG. 3(B) is an enlarged view of the left side view of the slot array antenna.
Figure 3C:
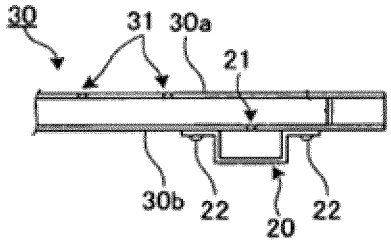
FIG. 3(C) is an enlarged cross-sectional view near the introduction waveguide 20 of the slot array antenna.

FIG. 3(A) is a three-way view of the slot array antenna according to this Embodiment 1. FIG. 3(B) is an enlarged view of the left side view thereof. Further, FIG. 3(C) is an enlarged cross-sectional view near the introduction waveguide 20. A plurality of slots 31 are arrayed vertically and horizontally in a metal plate 30*a* for the first conductor plane that is the top face of the radiation waveguide 30. This radiation waveguide 30 is constituted with the metal plate 30*a* for the first conductor plane and a metal plate 30*b* for the second conductor plane. The first conductor plane metal plate 30*a* extends from the top face of the radiation waveguide 30 via the side faces thereof to a part of the bottom face thereof. The second conductor plane metal plate 30*b* constitutes a substantial portion of the bottom face of the radiation waveguide 30. The first conductor plane metal plate 30*a* and the second conductor plane metal plate 30*b* are jointed with screws 33.

The introduction waveguide 20, as shown in FIG. 3(C), is configured by joining an aluminum plate bent into approximately a rectangular gutter shape to the second conductor plane metal plate 30*b* with a plurality of screws 22.

Slots 21 are formed in the top face of the introduction waveguide 20 (the face in contact with the second conductor plane metal plate 30*b* of the radiation waveguide 30). Therefore, the second conductor plane metal plate 30*b* is used both as the bottom face of the radiation waveguide and the top face of the introduction waveguide.

A radio wave absorber 34 is provided at one end of the radiation waveguide 30 on the farther side from the introduction waveguide 20. The other end opposed to this (the end portion on the closer side to the introduction waveguide 20) and the two side faces are used as short-circuited planes. Further, a distance from the short-circuited planes at the other end to a slot in the direction of propagating electromagnetic waves in the introduction waveguide 20 (a direction perpendicular to the direction of propagating electromagnetic waves in the radiation waveguide) is λg'/2 (λg' is a wavelength in the waveguide in the direction perpendicular to the direction of propagating electromagnetic waves in the radiation waveguide). Further, a distance from the closer end to the introduction waveguide 20 to the closest slot in the direction of propagating electromagnetic waves in the radiation waveguide is λg"/2 (λg" is a wavelength in the waveguide in the direction of propagating electromagnetic waves in the radiation waveguide). Thus, the direction of propagating electromagnetic waves in the radiation waveguide 30 (long-side direction) is used as a traveling-wave type, and the direction perpendicular to the direction of propagating electromagnetic waves in the radiation waveguide 30 (short-side direction) is used as a resonance type. Therefore, using the short-side direction of the radiation waveguide as the resonance type allows to dispose many slots even when the short side is shortened, which is advantageous to downsizing.

The joining portions between this first conductor plane metal plate 30*a* and the second conductor plane metal plate 30*b* are located at positions corresponding to nodes of the guide-wall currents determined by a mode of electromagnetic waves propagating in the radiation waveguide 30. This prevents a radio wave leakage at the joining portions between the first conductor plane metal plate 30*a* and the second conductor plane metal plate 30*b* (discontinuous portions).

A part of the slots 31 provided in the radiation waveguide 30 described above is provided (by cutting) from the top face of the radiation waveguide 30 to the side faces. This allows to utilize an aperture face of the antenna effectively, thereby contributing to downsizing of the antenna. These slots 31 are formed by, for example, NC turret punching in a state of the metal plate before bending the side portions.

Further, supporting members 32 are disposed at a plurality of positions between the first conductor plane metal plate 30*a* and the second conductor plane metal plate 30*b* described above. These supporting members 32 keep the distance constant between the first conductor plane metal plate 30*a* and the second conductor plane metal plate 30*b*, while improving the rigidity of the entire radiation waveguide 30. Specifically, as shown in FIG. 3(B), spacers 32*s* are disposed between the first conductor plane metal plate 30*a* and the second conductor plane metal plate 30*b*, and screws 32*a* and 32*b* are threadedly engaged with these spacers 32*s* from the outside. These supporting members 32 are disposed at positions corresponding to nodes of the electromagnetic waves propagating in the radiation waveguide 30 and nodes of the guide-wall currents. This allows to avoid adverse effects on the electromagnetic waves propagating in the radiation waveguide 30.

Note that a foamed dielectric body having a low dielectric constant may be adhered to between the metal plates to have a structure in which this dielectric body is a waveguide space. This structure leads to a sandwich structure with the dielectric body and metal plates, thereby increasing the rigidity of the entire antenna.

FIG. 4 shows two examples of the electromagnetic wave propagation mode inside the introduction waveguide 20 described above.

Figure 4A:
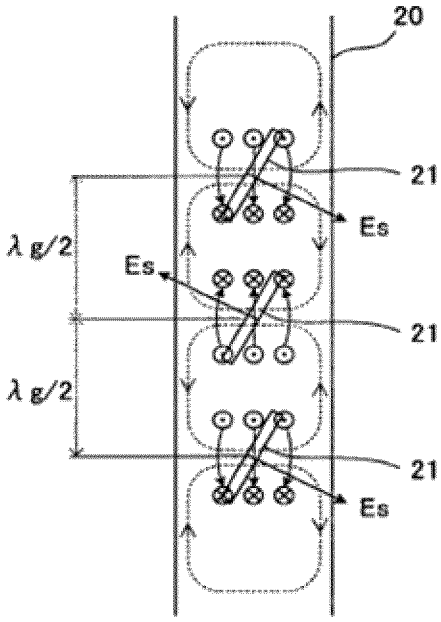
FIG. 4(A) is a diagram in which slots 21 are tilted by a predetermined angle to the same direction, and they are arranged at a pitch of ½ wavelength of a wavelength λg inside the waveguide.
Figure 4B:
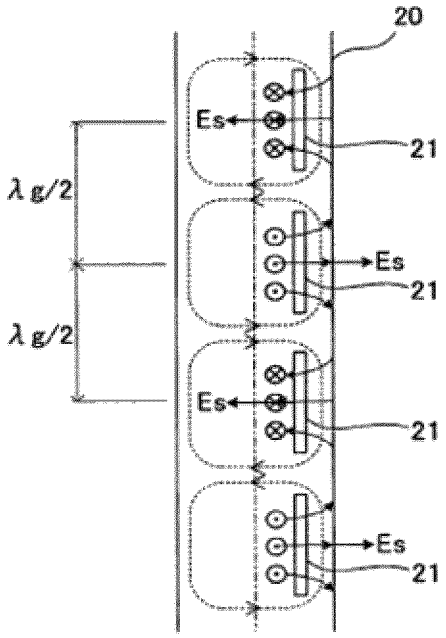
FIG. 4(B) is a diagram in which the slots 21 are arranged at a pitch of ½ wavelength of the wavelength λg inside the waveguide, at positions offset either to the right or left (to the right side) from a center line shown as a dashed-dotted line oriented in the direction of propagating electromagnetic waves in the introduction waveguide 20, and along the direction of propagating the electromagnetic waves in the introduction waveguide 20.

In either of the examples in FIGS. 4(A) and 4(B), an excitation probe is provided inside the introduction waveguide 20, and the excitation probe is supplied with power via a coaxial connector from the outside. The introduction waveguide 20 is short-circuited at both end portions or at one of the end portions, and is used as a resonance type inside which standing waves occur. Broken-line loops in the figures represent magnetic field loops that circle around portions with a high electric field intensity. Further, solid-line arrows represented as bridging the adjacent magnetic field loops represent directions and a distribution of the guide-wall currents. Slots 21 are formed to cut off this guide-wall current.

In the example shown in FIG. 4(A), the slots 21 are tilted in the same direction at a predetermined angle, and are disposed at a pitch of one-half of the wavelength λg in the waveguide. Further, in the example shown in FIG. 4(B), the slots 21 are disposed at positions offset either to the right or the left (to the right side in FIG. 4(B)) from the center line shown as a dashed-dotted line oriented in the direction of propagating electromagnetic waves in the introduction waveguide 20 (the longitudinal direction of the introduction waveguide 20), and are disposed along the direction of propagating electromagnetic waves in the introduction waveguide 20 at the pitch of one-half of the wavelength λg in the waveguide.

In either of the structures of FIGS. 4(A) and 4(B), these slots 21 are formed to cut off the guide-wall current, which causes electromagnetic waves to be radiated, the electric field of which is oriented in such directions that are shown with the straight-line arrows Es from each of the slots 21.

Figure 5A:
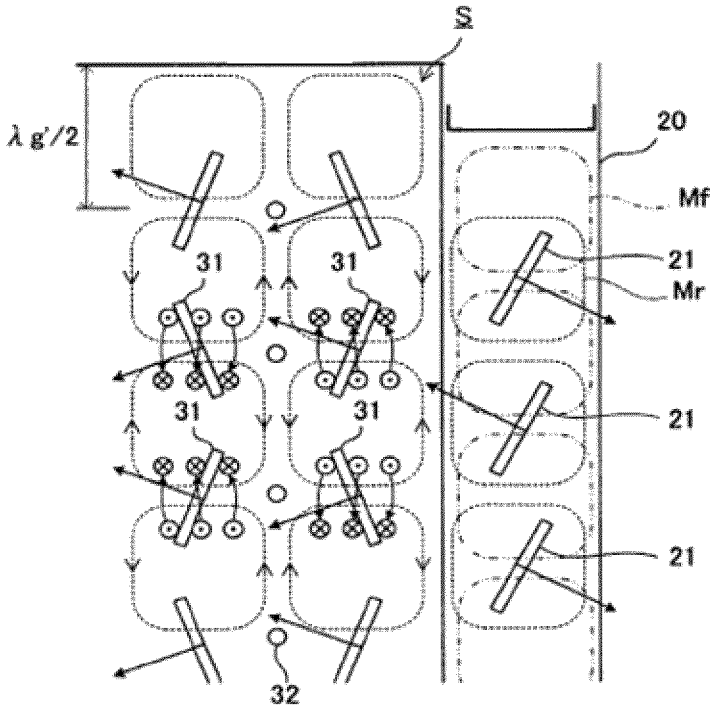
FIG. 5(A) is a diagram in the case where the arrangement of the slots of the introduction waveguide of the slot array antenna is the structure shown in FIG. 4(A).
Figure 5B:
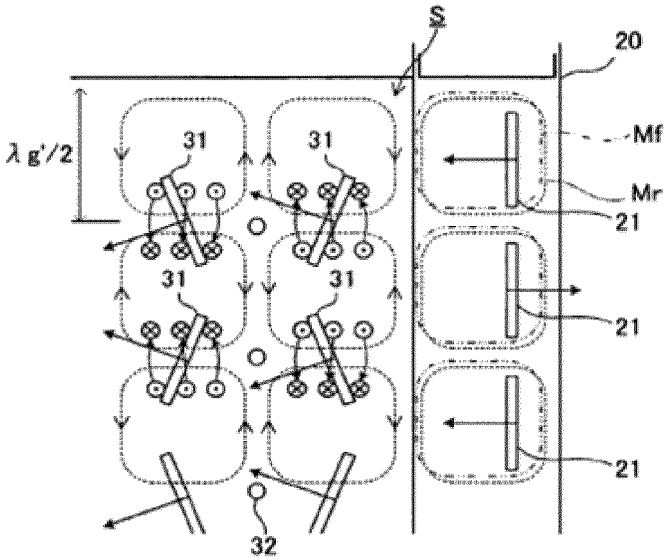
FIG. 5(B) is a diagram in the case where the arrangement of the slots of the introduction waveguide of the slot array antenna is the structure shown in FIG. 4(B).

FIG. 5 shows two examples, the electromagnetic wave propagation mode inside the introduction waveguide and the electromagnetic wave propagation mode inside the radiation waveguide. FIG. 5(A) is an example of the case where the structure of the introduction waveguide 20 is the one shown in FIG. 4(A), and FIG. 5(B) is an example of the case where the structure of the introduction waveguide 20 is the one shown in FIG. 4(B).

In FIGS. 5(A) and 5(B), dashed-two dotted line loops represent magnetic field loops of resonance mode (standing waves) inside the introduction waveguide, and broken-line loops represent magnetic field loops of the electromagnetic waves excited inside the radiation waveguide. Between FIG. 5(A) and FIG. 5(B), the standing waves inside the introduction waveguide 20 are shifted by π/2.

In either of the structures in FIGS. 5(A) and 5(B), electromagnetic waves radiated from the slots 21 of the introduction waveguide 20 cause electromagnetic waves in TEn0-mode to propagate in the waveguide space S of the radiation waveguide. That is, because the slots 21 formed in the introduction waveguide 20 are disposed at every λg/2, the electromagnetic waves are so radiated that the electric field is oriented in the opposite directions alternately. This causes the TEn0-mode to occur in the waveguide space S. Here, n is the number of peaks in the electric field intensity distribution in the width direction of the radiation waveguide (the direction of propagating electromagnetic waves in the introduction waveguide 20). Hereinafter, this mode is referred to as a higher-order mode of TE-mode.

In this example, although each slot of the slot array of the introduction waveguide 20 is provided at every one-half of the wavelength λg in the waveguide in the direction of propagating electromagnetic waves in the introduction waveguide 20, the slot may be provided at every λg or the like. Providing at the pitch of an integer multiple of λg allows the TEM-mode to occur in the radiation waveguide. Further, it can be presumed that providing at the pitch of an odd number multiple of λg/2 allows the TEn0-mode to occur in the radiation waveguide.

In the waveguide space S inside the radiation waveguide shown in FIGS. 5(A) and 5(B), broken-line loops represent magnetic field loops that circle around portions with a high electric field intensity. Further, solid-line arrows represented as bridging the adjacent magnetic field loops represent directions and a distribution of the guide-wall currents.

The slots 31 formed in the radiation waveguide 30 are formed at such positions to cut off the guide-wall currents occurred by the higher-order mode described above, and the tilt directions of the slots 31 are tilted alternately (serial-type) so that the directions of the electric field to be radiated are oriented in the same direction. That is, the slots 31 are formed so that the primary wave-polarizing planes of the radiated electric field are oriented in the same direction by being coupled with the higher-order mode electromagnetic waves inside the waveguide space S and so that the polarized wave components perpendicular to the primary wave-polarizing planes are mutually cancelled out.

The resultant vector of the electric field components of the electromagnetic waves radiated from the plurality of slots 31 is oriented in the longitudinal direction of the radiation waveguide 30 (the direction of propagating electromagnetic waves). Therefore, when this slot array antenna is disposed so that the longitudinal direction thereof is horizontal, this slot array antenna can be used as a horizontal wave-polarizing antenna.

In the example shown in FIG. 3, although all of the tilt angles of the slots 31 formed in the radiation waveguide 30 are illustrated to be the same, the tilt angles may also be configured so that the slots 31 become less tilted as departing from the center in the direction of propagating electromagnetic waves (the longitudinal direction) toward the directions of both ends. The radiation efficiency is enhanced with these slots 31 being more greatly tilted, because the angles with respect to the direction cutting off the guide-wall current becomes greater. When the tilt angles are zero, the radiation of electromagnetic waves is approximately zero, because the guide-wall currents are hardly cut off. Therefore, setting the tilt angles of the slots 31 as described above leads to a radiation intensity distribution where the radiation intensity becomes the maximum at the center in the long-side direction of the radiation waveguide 30 and the radiation intensity becomes gradually lower as departing from the center. This allows to suppress the occurrence and the intensity of side lobes.

Note that, while the direction of propagating electromagnetic waves in the radiation waveguide 30 (the long-side direction) is used as a traveling-wave type in the examples described above, this direction of propagating electromagnetic waves (the long-side direction) may also be used as a resonance type. In such a case, one end of the radiation waveguide 30 on the distant side from the introduction waveguide 20 is made to be a short-circuited plane without providing a radio wave absorber thereat. Then, the distance from this short-circuited plane to the closest slot in the direction of propagating electromagnetic waves in the radiation waveguide is λg"/2 (λg" is a wavelength in the waveguide of the direction of propagating electromagnetic waves in the radiation waveguide). The distance from the other three short-circuited planes to the slots is similar to the case with the traveling-wave type.

Note that an interval d of the adjacent slots 31 formed in the radiation waveguide 30 in the longitudinal direction of the radiation waveguide 30 (the direction of propagating electromagnetic waves) of the embodiments shown in FIGS. 5(A) and 5(B) is $d=\lambda g'/2$ in the resonance type, and $d>\lambda g'/2$ or $d<\lambda g'/2$ in the travelling-wave type.

Figure 16A:
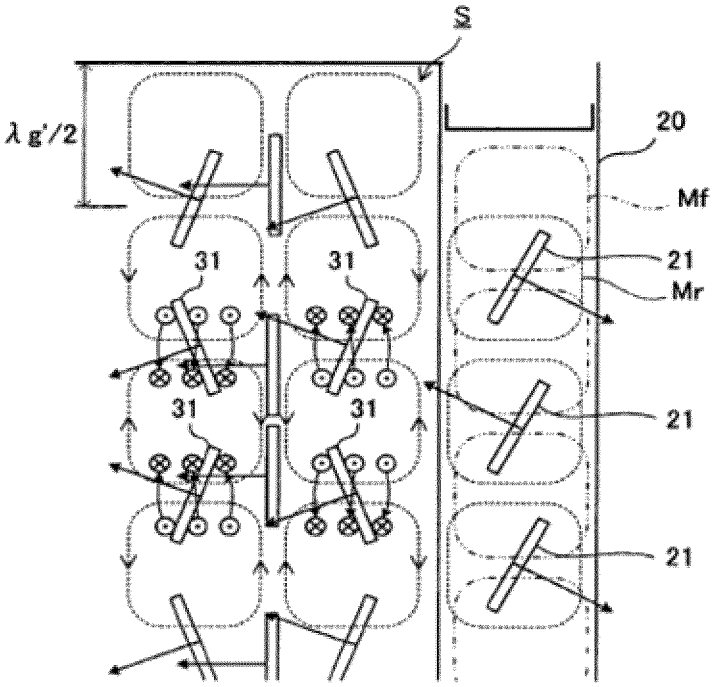
FIG. 16(A) is a diagram showing a relationship between an electromagnetic wave propagation mode inside a radiation waveguide and slots in a structure in which slots 21 of the introduction waveguide 20 are tilted by a predetermined angle to the same direction, and they are arranged at a pitch of ½ wavelength of a wavelength λg inside the waveguide.
Figure 16B:
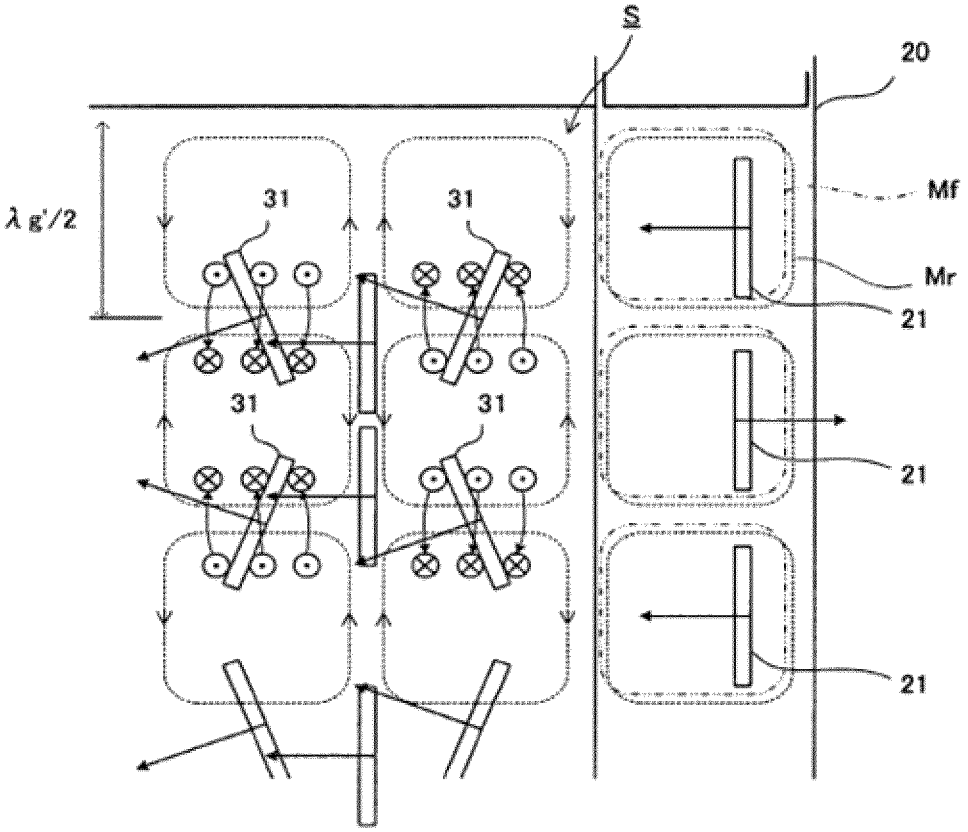
FIG. 16(B) is a diagram showing a relationship between an electromagnetic wave propagation mode inside a radiation waveguide and slots in a structure in which slots 21 are arranged at a pitch of ½ wavelength of the wavelength λg inside the waveguide, at positions offset either to the right or left (to the right side) from a center line shown as a dashed-dotted line oriented in the direction of propagating electromagnetic waves in the introduction waveguide 20, and along the direction of propagating the electromagnetic waves in the introduction waveguide 20.

Another embodiment is described using FIGS. 16(A) and 16(B).

In FIGS. 16(A) and 16(B), dashed-two dotted line loops represent magnetic field loops of resonance mode (standing waves) inside the introduction waveguide, and broken-line loops represent magnetic field loops of the electromagnetic waves excited inside the radiation waveguide. Between FIG. 16(A) and FIG. 16(B), the standing waves inside the introduction waveguide 20 are shifted by π/2. Note that a structure inside the introduction waveguide 20 and an aspect of propagating electromagnetic waves of the embodiment shown in FIGS. 16(A) and 16(B) are the same as those of the embodiment shown in FIGS. 5(A) and 5(B), respectively. A point different between the embodiment shown in FIGS. 16(A) and 16(B) and the embodiment shown in FIGS. 5(A) and 5(B) is arraying of the slots formed in the radiation waveguide.

In FIGS. 16(A) and 16(B), the slots tilted in the longitudinal direction of the radiation waveguide (the direction of propagating electromagnetic waves) formed in the radiation waveguide 30 and the non-tilted slots are arrayed alternately. An interval between the tilted slots and the non-tilted slots is set approximately λg'/4. An effect obtained by this configuration is to reduce a radiation conductance or impedance imposed on each slot. Thereby, the tilt angle of each slot or the offset amount of each slot can be reduced, and, for example, an unnecessary component of the perpendicular polarized wave component can be reduced.

Next, a slot array antenna according to Embodiment 2 will be explained.

Figure 6:
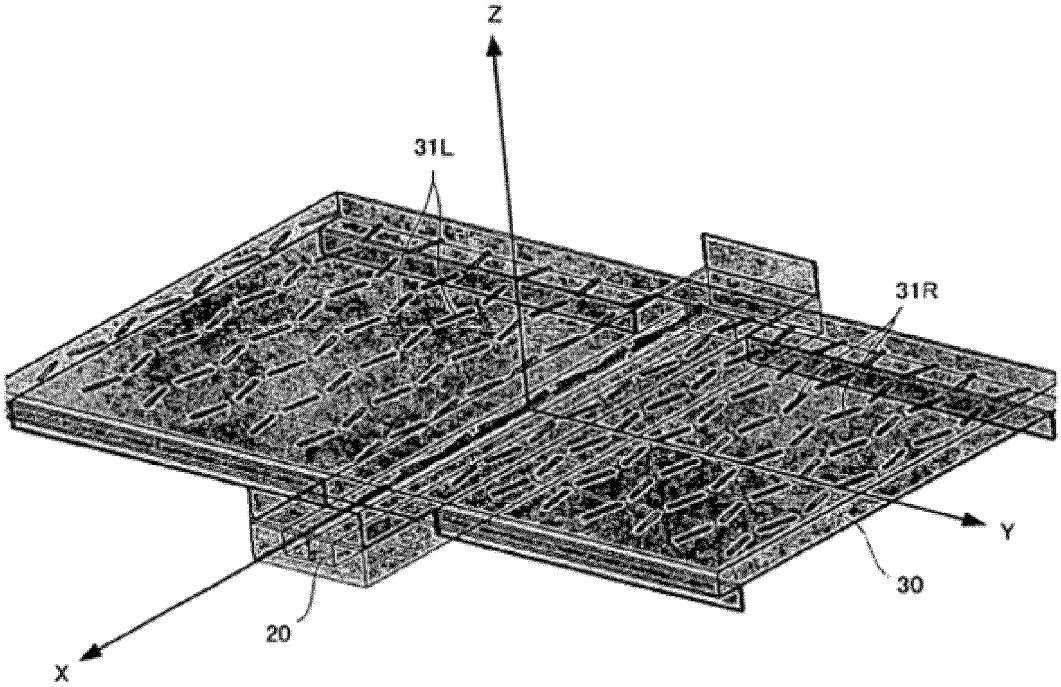
FIG. 6 is a perspective view of a slot array antenna according to Embodiment 2.
Figure 7:
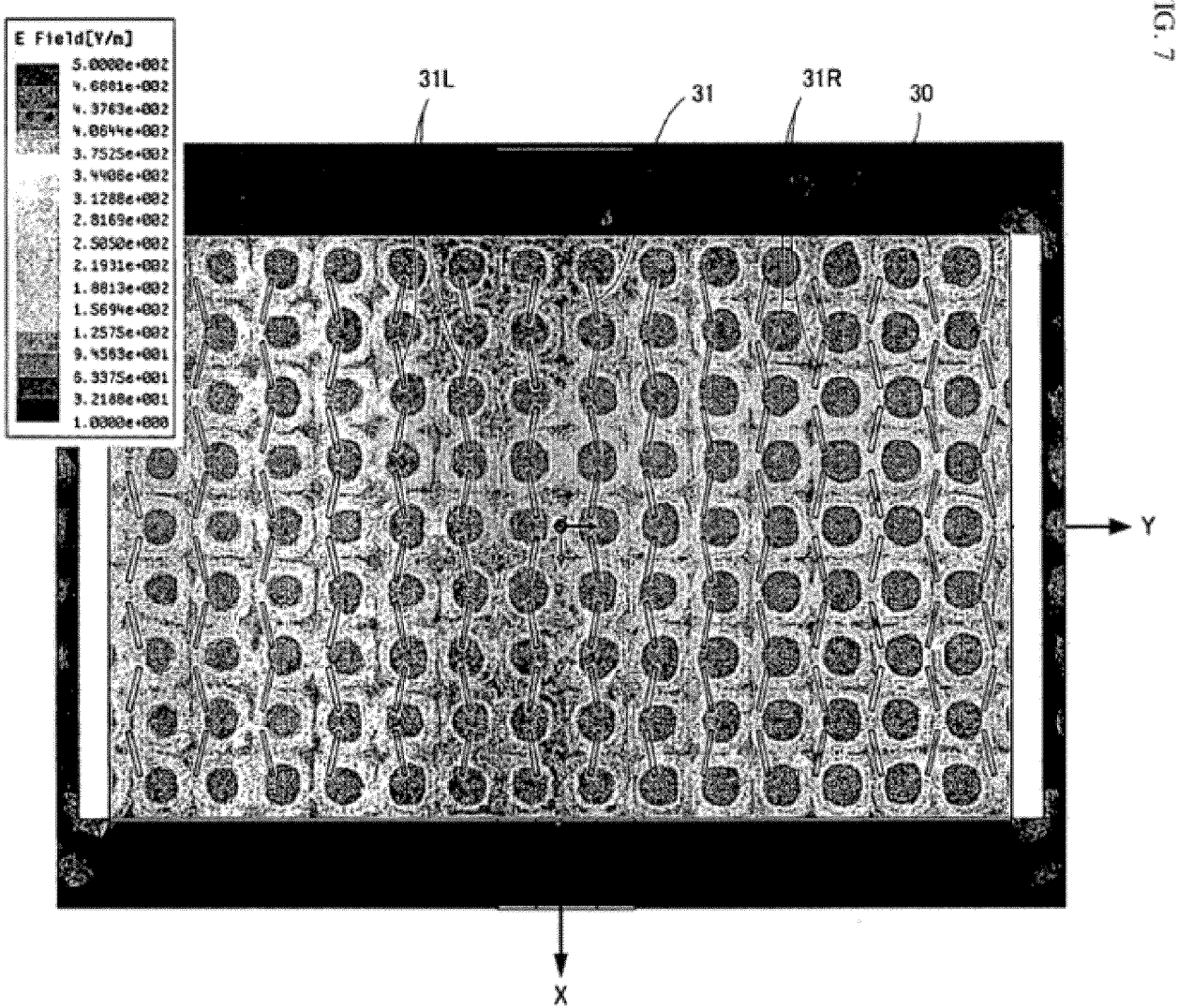
FIG. 7 is a diagram showing a relationship between an electric field distribution of the slot array antenna and slots.

FIG. 6 is a perspective view of the slot array antenna according to Embodiment 2. Further, FIG. 7 is a plan view showing a positional relationship between an electric field distribution of an electromagnetic wave propagation mode occurring in a radiation waveguide 30 of the slot array antenna described above and slots.

In Embodiment 1, a structural example of an end-feed type is illustrated where electromagnetic waves are supplied from one end portion of a radiation waveguide via an introduction waveguide. In Embodiment 2, an introduction waveguide 20 is disposed in a bottom portion of a center portion of a radiation waveguide 30 to make it as a center-feed type.

In this center-feed type as well, the slots formed in the introduction waveguide 20 are tilted in the same direction as shown in FIG. 5. This causes a higher-order mode of TE-mode to occur in the radiation waveguide 30. The arrangement of the plurality of slots formed in the top face of the radiation waveguide 30 is basically similar to that of the end-feed type shown in Embodiment 1. However, in Embodiment 2, arrayed pitches in Y-direction (the longitudinal direction) of slots 31L and 31R are different between the right side and the left side of the introduction waveguide 20 to improve a VSWR (Voltage Standing Waves Ratio) of the antenna. While the arrayed pitch of the slots 31 in Y-direction of the radiation waveguide 30 is basically one-half of the wavelength λg in the waveguide, the pitch of the slots 31L on the left side is extended from λg/2 by about 10%, and the pitch of the slots 31R on the right side is shortened by about 10%. This causes the beam direction to be tilted against Z-direction (normal direction) of the radiation waveguide 30 by about 3° toward the right direction on the left side and by about 3° toward the left direction on the right side.

As described above, shifting the slot pitches from λg/2 causes phases of the reflection waves occurring in each slot to be shifted respectively as is well known, which improves the VSWR of the antenna.

Next, a slot array antenna according to Embodiment 3 will be explained.

Figure 8:
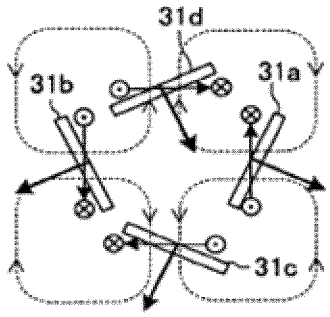
FIG. 8 is a diagram showing a relationship between an electromagnetic wave propagation mode inside a radiation waveguide and slots in a slot array antenna according to Embodiment 3.

FIG. 8 is a diagram showing a relationship between an electromagnetic wave mode occurring in a radiation waveguide of the slot array antenna for circular polarized waves and the slots to be formed in the radiation waveguide according to Embodiment 3.

In this example, broken-line loops in FIG. 8 represent magnetic field loops that circle around portions where the electric field intensity is high. Further, solid-line arrows represented as bridging the adjacent magnetic field loops represent directions and a distribution of guide-wall currents. FIG. 8 shows some of the plurality of slots arrayed vertically and horizontally.

The slots 31*a* and 31*b* are similar to those formed in the radiation waveguides in the slot array antennas shown in Embodiment 1 and Embodiment 2, and are so disposed as to cut off the guide-wall current flowing in directions perpendicular to the directions of propagating electromagnetic waves in the radiation waveguide.

On the other hand, the slots 31*c* and 31*d* are so disposed as to cut off the guide-wall current flowing in the direction of propagating electromagnetic waves in the radiation waveguide.

Therefore, the phase of the electric field radiated from the slots 31*a* and 31*b* described above and the phase of the electric field radiated from the slots 31*c* and 31*d* described above being shifted by π/2 causes the electromagnetic waves of circular polarized waves to be radiated.

In general, for the slots, a susceptance changes according to the slot length, and the imaginary term of the susceptance changes according to the shift from the resonance state of the slots. Therefore, the phase of the electromagnetic waves radiated from the slots changes according to the slot length. Because of this, the slot length of each slot is determined so that the phase of the electric field radiated from the slots 31*a* and 31*b* described above and the phase of the electric field radiated from the slots 31*c* and 31*d* described above are shifted by +π/2 or by −π/2.

In this way, the antenna acts as an antenna for clockwise turning polarizations or anticlockwise turning polarizations according to the phase shift direction described above.

Next, a slot array antenna according to Embodiment 4 will be explained.

FIG. 9 is a diagram showing a relationship between an electromagnetic wave mode occurring in a radiation waveguide of the slot array antenna for circular polarized waves and slots to be formed in the radiation waveguide according to Embodiment 4.

In this example, the radiation waveguide is used as a traveling-wave type. Broken-line loops in FIG. 9 represent magnetic field loops that circle around portions where the electric field intensity is high. Further, solid-line arrows represented as bridging the adjacent magnetic field loops represent directions and a distribution of guide-wall currents. FIG. 9 shows some of the plurality of slots arrayed vertically and horizontally. Here, the traveling waves travel in the left direction in the figure.

Figure 9A:
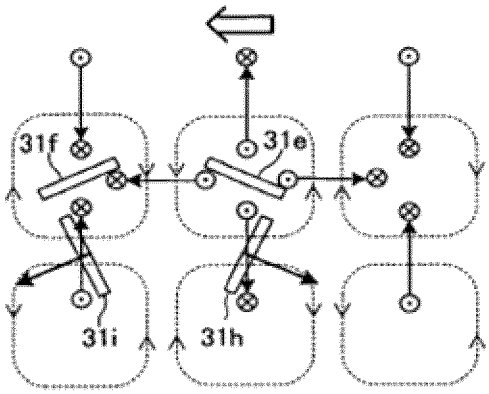
FIG. 9(A) is a diagram showing a relationship between an electromagnetic wave propagation mode inside a radiation waveguide (horizontal direction) and slots in a slot array antenna according to Embodiment 4.

In the state of FIG. 9(A), electromagnetic waves are radiated from the slots 31*h* and 31*i*, the electric fields of which are oriented in such directions that are shown with straight-line arrows extended from these slots (horizontal direction).

Figure 9B:
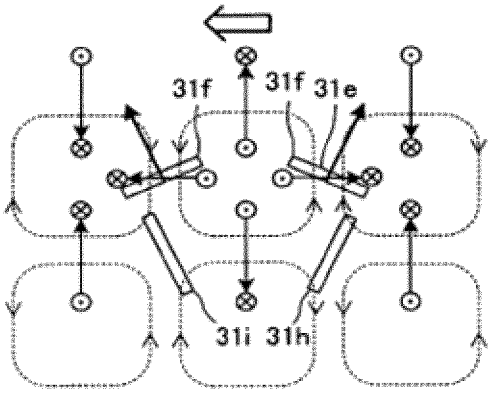
FIG. 9(B) is a diagram showing a relationship between an electromagnetic wave propagation mode inside a radiation waveguide (vertical direction) and the slots in the slot array antenna according to Embodiment 4.

In the state of FIG. 9(B), electromagnetic waves are radiated from the slots 31*f* and 31*g*, the electric fields of which are oriented in such directions that are shown with straight-line arrows extended from these slots (vertical direction).

There being an elapsed time (phase difference) from the state of FIG. 9(A) to the state of FIG. 9(B) results in radiation of electromagnetic waves of the circular polarized waves.

Next, a slot array antenna according to Embodiment 5 will be explained.

Figure 10:
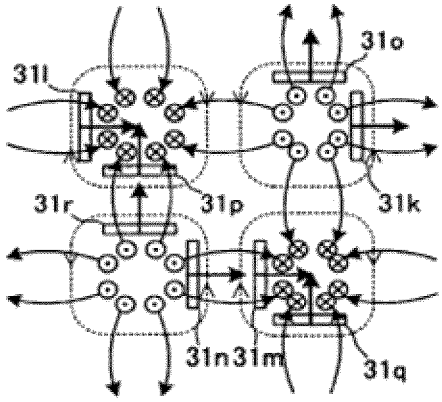
FIG. 10 is a diagram showing a relationship between an electromagnetic wave propagation mode inside a radiation waveguide and slots in a slot array antenna according to Embodiment 5.

FIG. 10 is a diagram showing a relationship between an electromagnetic wave mode occurring in a radiation waveguide of the slot array antenna for circular polarized waves and slots to be formed in the radiation waveguide according to Embodiment 5.

In this example, the radiation waveguide is used as a resonance type. Broken-line loops in FIG. 10 represent magnetic field loops that circle around portions where the electric field intensity is high. Further, solid-line arrows represented as bridging the adjacent magnetic field loops represent directions and a distribution of guide-wall currents. FIG. 10 shows some of the plurality of slots arrayed vertically and horizontally.

Slots 31*k*, 31*l*, 31*m*, and 31*n* are so disposed as to cut off the guide-wall currents flowing in the directions of propagating electromagnetic waves in the radiation waveguide. Therefore, electromagnetic waves are radiated, the electric fields of which are oriented in such a direction that is shown with straight-line arrows extended from these slots (horizontal direction). Further, slots 31*o*, 31*p*, 31*q*, and 31*r* are so disposed as to cut off the guide-wall currents flowing in directions perpendicular to the directions of propagating electromagnetic waves in the radiation waveguide. Therefore, electromagnetic waves are radiated, the electric fields of which are oriented in such a direction that is shown with the straight-line arrows extended from these slots (vertical direction).

The phase of the electromagnetic waves where the wave-polarizing planes by the slots 31*k*, 31*l*, 31*m*, 31*n* and the like described above are oriented in the horizontal direction and the phase of the electromagnetic waves where the wave-polarizing planes by the slots 31*o*, 31*p*, 31*q*, 31*r* and the like described above are oriented in the vertical direction are shifted by $\pi/2$. This phase difference is determined by the slot length of each slot as illustrated in Embodiment 3. The antenna acts as an antenna for clockwise turning polarizations or anticlockwise turning polarizations according to the phase shift direction described above.

Figure 11:
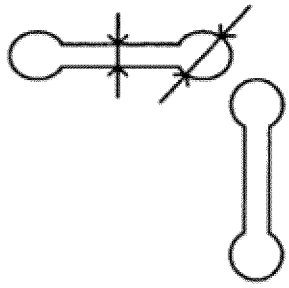
FIG. 11 is a diagram showing a shape of the slot in the slot array antenna.

With the slot arrangement shown in FIG. 10, interference tends to occur because the end portions of the slots extending in the vertical direction and the end portions of the slots extending in the horizontal direction are close to one another. In this case, both end portions of each slot are formed in a circular shape as shown in FIG. 11. Such a shape allows to shorten the structural slot length of the slots. A susceptance of the slots may be determined by the diameter of the circular portion and the width of the straight portion of the slots.

Next, a slot array antenna according to Embodiment 6 will be explained.

Figure 12:
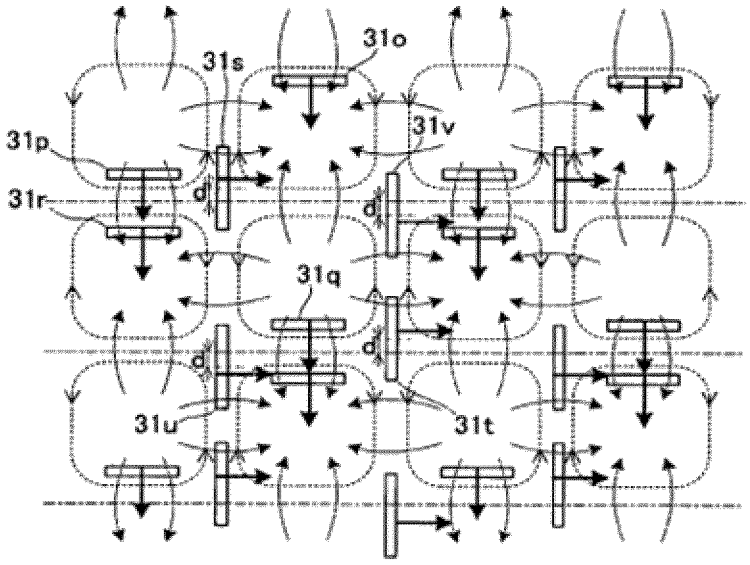
FIG. 12 is a diagram showing a relationship between an electromagnetic wave propagation mode inside a radiation waveguide and slots in a slot array antenna according to Embodiment 6.

FIG. 12 is a diagram showing a relationship between an electromagnetic wave mode occurring in a radiation waveguide of the slot array antenna for circular polarized waves and slots to be formed in the radiation waveguide according to Embodiment 6.

In this example, broken-line loops in FIG. 12 represent magnetic field loops that circle around portions where the electric field intensity is high. Further, solid-line arrows represented as bridging the adjacent magnetic field loops represent directions and a distribution of guide-wall currents. FIG. 12 shows some of the plurality of slots arrayed vertically and horizontally.

Slots 31*o*, 31*p*, 31*q*, and 31*r* are so disposed at positions shifted alternately from the centers of the magnetic field loops in the radiation waveguide as to cut off the guide-wall currents flowing in perpendicular directions to the direction of propagating electromagnetic waves in the radiation waveguide. Therefore, electromagnetic waves are radiated, the electric fields of which are oriented in such a direction that is shown with the straight-line arrows extended from these slots (vertical direction).

Further, slots 31*s*, 31*t*, 31*u*, and 31*v* are so disposed as to cut off the guide-wall currents flowing in the directions of propagating electromagnetic waves in the radiation waveguide. These slots 31*s*, 31*t*, 31*u*, and 31*v* cutting off the guide-wall currents flowing in the directions of propagating electromagnetic waves in the radiation waveguide are disposed at positions shifted alternately by an offset d from the center lines (dashed-dotted lines) of the valleys (nodes) of the electromagnetic field distribution in the radiation waveguide. Therefore, electromagnetic waves are radiated, the electric fields of which are oriented in such a direction that is shown with the straight-line arrows extended from these slots (horizontal direction).

The phase of the electromagnetic waves where the wave-polarizing planes by the slots 31*s*, 31*t*, 31*u*, 31*v* and the like described above are oriented in the horizontal direction and the phase of the electromagnetic waves where the wave-polarizing planes by the slots 31*o*, 31*p*, 31*q*, 31*r* and the like described above are oriented in the vertical direction are shifted by $\pi/2$ to each other. This phase difference is determined by the slot length of each slot as illustrated in Embodiment 3. The antenna acts as an antenna for clockwise turning polarizations or anticlockwise turning polarizations according to the phase shift direction described above.

Note that, in the structure shown in FIG. 12, the antenna acts as a slot array antenna for circular polarized waves regardless of the radiation waveguide being a traveling-wave type or a resonance type.

Next, a slot array antenna according to Embodiment 7 will be explained.

Figure 13:
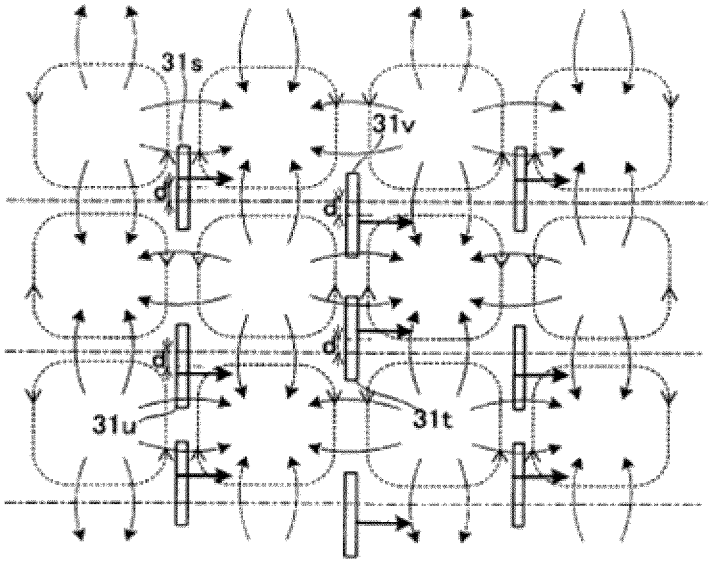
FIG. 13 is a diagram showing a relationship between an electromagnetic wave propagation mode inside a radiation waveguide and slots in a slot array antenna according to Embodiment 7.

FIG. 13 is a diagram showing a relationship between an electromagnetic wave mode occurring in a radiation waveguide of the slot array antenna for horizontally polarized waves and slots to be formed in the radiation waveguide according to Embodiment 7.

In this example, broken-line loops in FIG. 13 represent magnetic field loops that circle around portions where the electric field intensity is high. further, solid-line arrows represented as bridging the adjacent magnetic field loops represent directions and a distribution of guide-wall currents. FIG. 13 shows some of the plurality of slots arrayed vertically and horizontally.

Each slot shown as slots 31*s*, 31*t*, 31*u*, 31*v* or the like in FIG. 13 is a slot cutting off the guide-wall current flowing in the direction of propagating electromagnetic waves in the radiation waveguide among the slots shown in FIG. 12 as Embodiment 6. Therefore, electromagnetic waves are radiated, the electric fields of which are oriented in such a direction that is shown with straight-line arrows extended from these slots (horizontal direction). As a result, this antenna acts as an antenna for horizontally polarized waves, the wave-polarizing plane of which is parallel to the direction of propagating electromagnetic waves.

Next, a slot array antenna according to Embodiment 8 will be explained.

Figure 14:
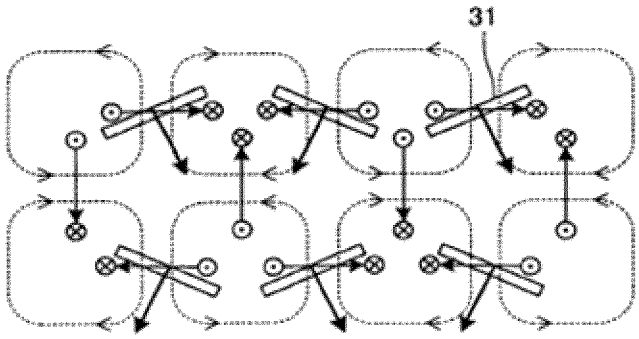
FIG. 14 is a diagram showing a relationship between an electromagnetic wave propagation mode inside a radiation waveguide and slots in a slot array antenna according to Embodiment 8.

FIG. 14 is a diagram showing a relationship between an electromagnetic wave mode occurring in a radiation waveguide of the slot array antenna for vertically polarized waves and slots to be formed in the radiation waveguide according to Embodiment 8.

In this example, the radiation waveguide is used as a resonance type. Broken-line loops in FIG. 14 represent magnetic field loops that circle around portions where the electric field intensity is high. Further, solid-line arrows represented as bridging the adjacent magnetic field loops represent directions and a distribution of guide-wall currents. FIG. 14 shows some of the plurality of slots arrayed vertically and horizontally.

Each of the slots 31 is so disposed as to cut off the guide-wall current flowing in the direction of propagating electromagnetic waves in the radiation waveguide. Therefore, electromagnetic waves are radiated, the electric fields of which are oriented in such directions that are shown with straight-line arrows extended from these slots (vertical direction). As a result, this antenna acts as an antenna for vertically polarized waves, the wave-polarizing plane of which is perpendicular to the direction of propagating electromagnetic waves.

Next, a slot array antenna according to Embodiment 9 will be explained.

Figure 15:
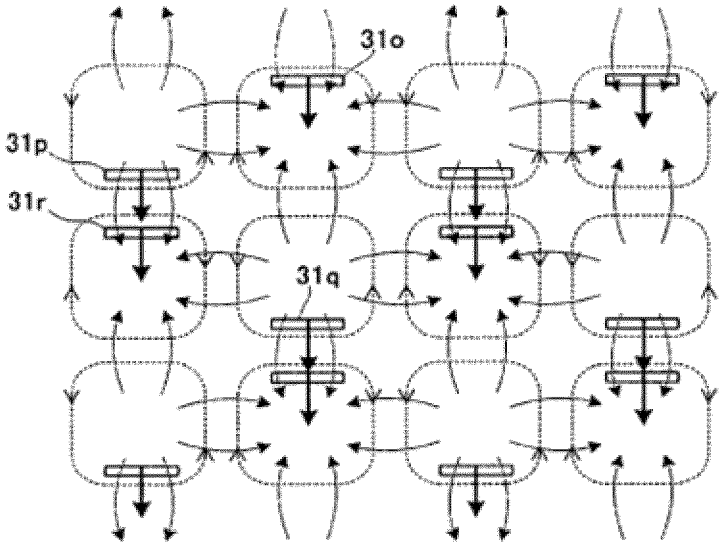
FIG. 15 is a diagram showing a relationship between an electromagnetic wave propagation mode inside a radiation waveguide and slots in a slot array antenna according to Embodiment 9.

FIG. 15 is a diagram showing a relationship between an electromagnetic wave mode occurring in a radiation waveguide of the slot array antenna for vertically polarized waves and slots to be formed in the radiation waveguide according to Embodiment 9.

In this example, broken-line loops in FIG. 15 represent magnetic field loops that circle around portions where the electric field intensity is high. Further, solid-line arrows represented as bridging the adjacent magnetic field loops represent directions and a distribution of the guide-wall currents. FIG. 15 shows some of the plurality of slots arrayed vertically and horizontally.

Each slot shown as slots 31*o*, 31*p*, 31*q*, 31*r* or the like in FIG. 15 is a slot cutting off the guide-wall current flowing in the perpendicular direction to the direction of propagating electromagnetic waves in the radiation waveguide among the slots shown in FIG. 12 as Embodiment 6. Therefore, electromagnetic waves are radiated, the electric fields of which are oriented in such a direction that is shown with straight-line arrows extended from these slots (vertical direction). As a result, this antenna acts as an antenna for vertically polarized waves, the wave-polarizing plane of which is perpendicular to the direction of propagating electromagnetic waves.

As described above, the case where the present invention is implemented as a slot array antenna for a radar has been explained. The slot array antenna of the present invention may also be utilized as an antenna for communication, broadcasting or the like other than this.

INDUSTRIAL APPLICABILITY

The slot array antenna of the present invention may be utilized as an antenna for a radar, communication, broadcasting or the like.

The invention claimed is:

1. A slot array antenna comprising:

a radiation waveguide having a first conductor plane in which a slot array is two-dimensionally arrayed, a second conductor plane in parallel to the first conductor plane, and side faces closing the first and second conductor planes, and having a slot array in the first conductor plane so that a space surrounded by the first and second conductor planes and the side faces is set to be a waveguide space;

an introduction waveguide having a slot array for introducing electromagnetic waves into the waveguide space; and excitation means for exciting the electromagnetic waves in the introduction waveguide, characterized in that:

each slot of the slot array formed in the introduction waveguide is provided at every ½ wavelength or integer multiple of ½ wavelength of the electromagnetic waves inside the introduction waveguide in the direction propagating the electromagnetic waves in the introduction waveguide, and electromagnetic waves of a high-order mode are excited in the radiation waveguide where a plurality of magnetic loops are arranged in the direction of propagating the electromagnetic waves in the introduction waveguide;

the slot array formed in the first conductor plane of the radiation waveguide is formed such that primary wave polarizing planes of radiated electric fields are oriented to the same direction by coupling to the electromagnetic waves of the high-order mode, and polarized wave components perpendicular to the primary wave polarizing planes cancel out for each other; and joining portions are provided for joining the first conductor plane and the second conductor plane, the joining portions being located at positions corresponding to nodes of guide-wall currents determined by a mode of electromagnetic waves propagating in the radiation waveguide.

2. The slot array antenna of claim 1, wherein some slots among the slots formed in the radiation waveguide extend to the side face of the radiation waveguide.

3. The slot array antenna of claim 1, wherein the first and second conductor planes of the radiation waveguide are made from metal plates, and a supporting member is provided at a node of the electromagnetic waves propagating inside the radiation waveguide to secure the metal plates together that constitute the first and second conductor planes.

4. The slot array antenna of claim 1, wherein a shape or an arrangement of each of the slots of the slot array formed in the first conductor plane of the radiation waveguide are determined such that an intensity of the radiated electromagnetic waves is lower as departing from the center of the radiation waveguide in the direction propagating the electromagnetic waves toward directions of both ends thereof.

5. The slot array antenna of claim 1, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

6. The slot array antenna of claim 2, wherein the first and second conductor planes of the radiation waveguide are made from metal plates, and a supporting member is provided at a node of the electromagnetic waves propagating inside the radiation waveguide to secure the metal plates together that constitute the first and second conductor planes.

7. The slot array antenna of claim 2, wherein a shape or an arrangement of each of the slots of the slot array formed in the first conductor plane of the radiation waveguide are determined such that an intensity of the radiated electromagnetic waves is lower as departing from the center of the radiation waveguide in the direction propagating the electromagnetic waves toward directions of both ends thereof.

8. The slot array antenna of claim 3, wherein a shape or an arrangement of each of the slots of the slot array formed in the first conductor plane of the radiation waveguide are determined such that an intensity of the radiated electromagnetic waves is lower as departing from the center of the radiation waveguide in the direction propagating the electromagnetic waves toward directions of both ends thereof.

9. The slot array antenna of claim 6, wherein a shape or an arrangement of each of the slots of the slot array formed in the first conductor plane of the radiation waveguide are determined such that an intensity of the radiated electromagnetic waves is lower as departing from the center of the radiation waveguide in the direction propagating the electromagnetic waves toward directions of both ends thereof.

10. The slot array antenna of claim 2, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

11. The slot array antenna of claim 3, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

12. The slot array antenna of claim 6, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

13. The slot array antenna of claim 4, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

14. The slot array antenna of claim 7, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

15. The slot array antenna of claim 8, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

16. The slot array antenna of claim 9, wherein the slot array formed in the radiation waveguide includes a plurality of slot pairs perpendicular to each other, and the slot array radiates the electromagnetic waves as circular polarized waves from the slot array with lengths or positions of the slots being determined so that phases of the electromagnetic waves radiated from the two slots constituting each of the slot pairs differ by 90°.

17. A slot array antenna comprising:

a radiation waveguide having a first conductor plane in which a slot array is two-dimensionally arrayed, a second conductor plane in parallel to the first conductor plane, and side faces closing the first and second conductor planes, and having a slot array in the first conductor plane so that a space surrounded by the first and second conductor planes and the side faces is set to be a waveguide space;

an introduction waveguide having a slot array for introducing electromagnetic waves into the waveguide space; and an excitation probe for exciting the electromagnetic waves in the introduction waveguide, characterized in that:

each slot of the slot array formed in the introduction waveguide is provided at every ½ wavelength or integer multiple of ½ wavelength of the electromagnetic waves inside the introduction waveguide in the direction propagating the electromagnetic waves in the introduction waveguide, and electromagnetic waves of a high-order mode are excited in the radiation waveguide where a plurality of magnetic loops are arranged in the direction of propagating the electromagnetic waves in the introduction waveguide;

the slot array formed in the first conductor plane of the radiation waveguide is formed such that primary wave polarizing planes of radiated electric fields are oriented to the same direction by coupling to the electromagnetic waves of the high-order mode, and polarized wave components perpendicular to the primary wave polarizing planes cancel out for each other; and joining portions are provided for joining the first conductor plane and the second conductor plane, the joining portions being located at positions corresponding to nodes of guide-wall currents determined by a mode of electromagnetic waves propagating in the radiation waveguide.

* * * * *